United States Patent [19]

Rebecq

[11] Patent Number: 4,838,415

[45] Date of Patent: Jun. 13, 1989

[54] FOLDABLE TEMPORARY ROADMARKERS AND CONTAINERS FOR STORING AND/OR TRANSPORTING SAME

[75] Inventor: Jean M. Rebecq, Toulon, France

[73] Assignee: Societe Civile Pour La Realisation D'Inventions Techniques—S.C.R.I.T., Toulon, France

[21] Appl. No.: 52,607

[22] Filed: May 19, 1987

[30] Foreign Application Priority Data

Jun. 5, 1986 [FR] France ..... 86 08247

[51] Int. Cl.[4] ..... B65D 77/00

[52] U.S. Cl. ..... 206/216; 40/590; 40/612; 296/37.6; 211/194

[58] Field of Search ..... 206/216, 573, 575; 224/273; 296/37.1, 37.6; 40/590, 593, 612; 211/59.2, 194

[56] References Cited

U.S. PATENT DOCUMENTS

| | | | |
|---|---|---|---|
| 2,230,635 | 2/1941 | Alderfer | 296/37.6 |
| 3,588,166 | 6/1971 | Day | 211/194 |
| 4,030,425 | 6/1977 | Yeomans | 211/194 |
| 4,519,409 | 5/1985 | Kinney et al. | 296/163 |
| 4,545,710 | 10/1985 | Hepp | 211/194 |

*Primary Examiner*—David T. Fidei

*Attorney, Agent, or Firm*—Balogh, Osann, Kramer, Dvorak, Genova & Traub

[57] ABSTRACT

This invention relates to a foldable roadmarker of the type comprising a vertical rectangular panel presenting colored bands and a foldable support composed of four feet articulated in two's to form two pairs of compasses located on either side of the panel and the two pairs of compasses are articulated on the same transverse rod which projects on both sides and which slides freely in two slots cut out in the vertical edges of the panel, which rod is adapted to engage in two slideways of a container for storing the roadmarkers.

5 Claims, 6 Drawing Sheets

FOLDABLE TEMPORARY ROADMARKERS AND CONTAINERS FOR STORING AND/OR TRANSPORTING SAME

FIELD OF THE INVENTION

The present invention relates to foldable temporary roadmarkers and to containers for storing and/or transporting same.

The technical sector of the invention is that of the construction of temporary roadmarking equipment used on highways for marking obstacles.

BACKGROUND OF THE INVENTION

It is compulsory to define the areas of roadworks or the obstacles which hinder traffic on the highways with the aid of temporary signs or roadmarkers. Among the latter, rectangular markers are currently used which are composed of a rectangular panel having a width of 25 cm and a height of 1 m, which panel bears alternately red and white coloured bands inclined by 45° to the right or to the left.

The problem to be solved is that of designing roadmarkers of this type mounted on a foldable support, which is adapted to allow a large number of markers to be rapidly placed in position and recovered, as roadworks or an accident frequently oblige a traffic lane to be neutralized over a large length.

One object of the present invention is to provide both foldable roadmarkers and a container for storing them which facilitate the operations of folding up the markers and the operations of unfolding and positioning and which enable these operations to be carried out in complete safety, without the operators risking being knocked over by a vehicle.

Another object of the invention is to provide roadmarkers mounted on a foldable support which, once open, takes up a large space over the ground, this giving it an excellent stability.

A further object of the invention is to provide foldable roadmarkers which may present signs on their two faces or which may temporarily support a road sign of circular, triangular or square form.

Yet another object of the invention is to provide a storage container which may contain a large number of folded roadmarkers and which may serve either as fixed storage magazine or as transporting vehicle by being placed on the flat semi-trailer of a truck or by being provided with an axle with wheels and a drawbar to serve as trailer.

Another object of the invention is to provide a container for storing the roadmarkers which further comprises means for storing temporary marker panels or thin plates capable of being placed on a foldable support bearing the roadmarkers, with the result that said container contains all the equipment necessary for marking roadworks.

It is a further object of the invention to provide containers for storing and/or transporting the foldable roadmarkers according to the invention adapted so that an operator may carry out the operations of folding and storing the markers in the container and/or the operations of unfolding and positioning the markers on a highway, without excessive fatigue.

Roadmarking devices are already known which comprise a foldable support composed of two pairs of feet articulated on each other.

Patent DE-C. No. 701 696 (GERDES) discloses devices in the form of extensible barriers provided with reflectors, which are placed on two pairs of feet forming two pairs of compasses of which the legs are connected by articulated connecting rods and whose apex slides in a slot.

Patent FR.A. No. 1 421 452 (BERTHIER) describes road marking panels comprising two feet which are articulated separately on a plate fast with the panel and which intersect each other.

Patent BE.A. No. 823 613 (DICOREP) describes roadmarking panels equipped with two pairs of foldable feet which are connected together by two connecting rods equipped with a device for blocking in open position.

SUMMARY OF THE INVENTION

The temporary roadmarkers according to the invention are of the type comprising at least one vertical rectangular flat panel presenting inclined coloured bands, which is mounted on a foldable support comprising two pairs of feet placed respectively on either side of said panel, each pair being composed of two feet articulated together and located in a vertical plane perpendicular to the plane of said panel and comprising, in addition, two crosspieces which connect together the two front feet and the two rear feet.

The objects of the invention are attained by means of foldable roadmarkers in which at least one of the two feet of each pair is articulated about a transverse rod which slides freely in two vertical slots cut out along the two vertical edges of said panel and which projects on both sides of said panel and said panel is extended upwardly by a bar bearing a transverse handle and said transverse rod as well as said handle are adapted to cooperate with slideways of a container for storing said roadmarkers.

According to a preferred embodiment, each pair of feet comprises two feet which are connected to said panel respectively by two superposed articulations which slide in said slot located on the same side of the panel or between two parallel panels and the foot which is connected to the lower articulation extends beyond this articulation and it is connected on the one hand to the other foot by a second articulation and, on the other hand, to the lower end of the lateral edge of said panel by an articulated connecting rod.

A container intended for storing foldable roadmarkers according to the invention comprises, in its upper part, at least one pair of horizontal and longitudinal rails of which the spaced apart relationship is slightly more than the length of the handles of the roadmarkers which slide in said rails and it comprises at least one pair of horizontal and longitudinal slideways of which the spaced apart relationship is slightly more than the length of the transverse rods of said roadmarkers which slide in said slideways and the height between said rails and said slideways is equal to the height between the handle and the upper ends of the slots of said roadmarkers.

According to a preferred embodiment, a container according to the invention further comprises a removable dispensing device which comprises a bearing structure provided with means for removably hooking it to the rear of said container, and at least one pair of rails and at least one pair of slideways of which the rear ends are placed respectively in alignment with said upper rails and said slideways when said dispenser is hooked to the container and said rails and slideways of the dispenser are curved downwardly and rearwardly, so that the vertical distance which separates them increases rearwardly.

The invention results in novel foldable roadmarkers and containers adapted especially to receive these roadmarkers and to facilitate folding or unfolding thereof.

The roadmarkers according to the invention present the advantage of being mounted on a foldable support which automatically takes the unfolded position under the sole effect of the weight of the roadmarker and which, in this unfolded position, is supported over a large surface on the ground, with the result that the roadmarker resists being blown over by the wind without it being necessary to ballast it or anchor the support to the ground as is the case with heretofore known roadmarkers.

The roadmarkers according to the invention used in association with the storing containers provided with two suspension rails in the upper part and with two lateral slideways for guiding the pivot pin of the articulated feet, make it possible to obtain automatic folding of the support simply by pushing the roadmarker inside the container. They also enable the support to be automatically unfolded by pushing the roadmarkers one by one towards the rear and, consequently, they enable the roadmarkers to be placed directly on the ground in a line by one operator only.

The foldable roadmarkers according to the invention may receive on their front face a temporary sign panel of triangular, circular or square shape to serve as support for this panel.

They may also receive a thin plate which may be slid in front of their front face or their rear face, this enabling them to be easily converted into double-face roadmarkers if they originally comprise one face only or into roadmarkers bearing different signs, for example coloured bands inclined in opposite direction.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
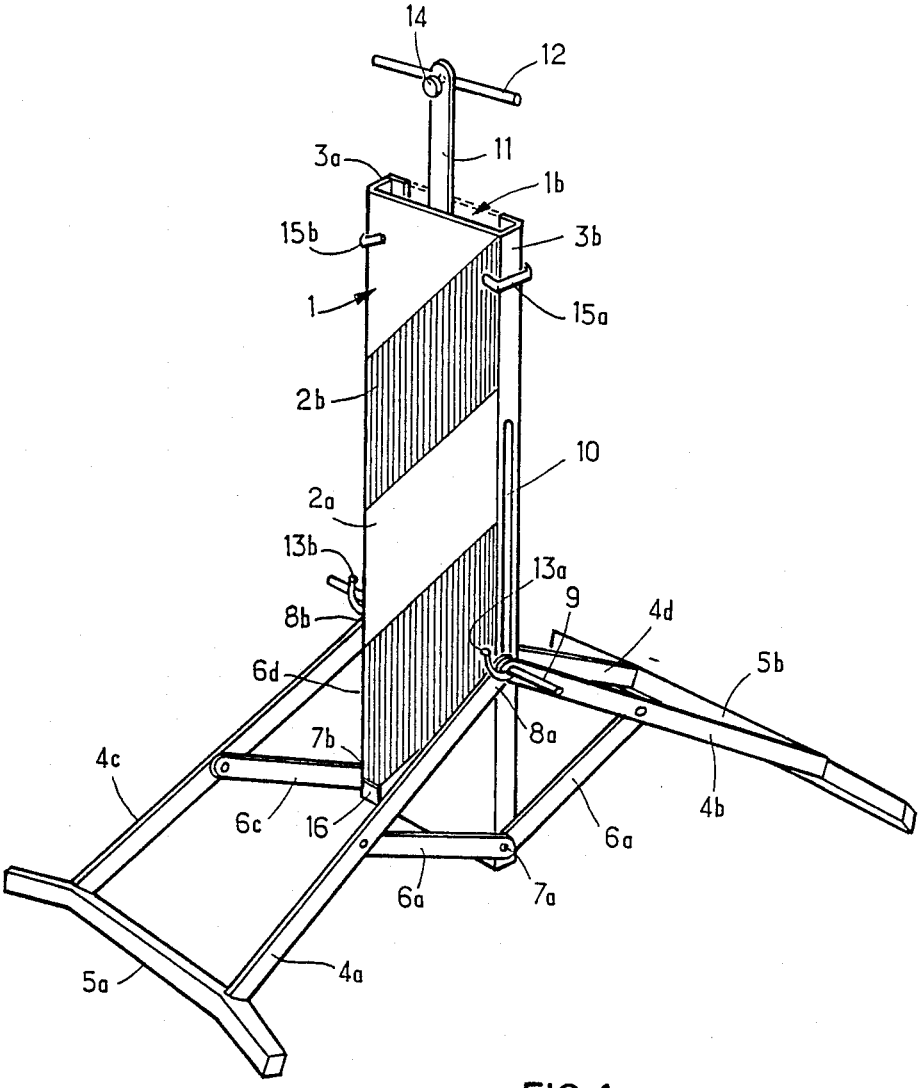
FIG. 1 is a view in perspective of a first embodiment of a foldable temporary roadmarker according to the invention.

Referring now to the drawings, FIGS. 1 to 6 show foldable temporary roadmarkers. These roadmarkers comprise a rectangular panel 1, elongated vertically, which is disposed perpendicularly to a traffic lane to indicate for example roadworks or an accident. The rectangular panel 1 presents on its front face inclined reflecting bands coloured alternately white for bands 2*a* and red for bands 2*b*.

The bands are inclined downwardly towards the side which the traffic must go around to avoid the obstacle, for example to the left in the case shown in FIG. 1.

These flat rectangular roadmarkers are known in France under the name of K5C roadmarkers.

The rectangular panel 1 comprises, along its two vertical edges, a reinforcing rib 3*a*, 3*b* in U-form. Ribs 3*a*, 3*b* are constituted for example by a double 90° fold of the sheet metal constituting the panel 1 or by U-sections welded to the back of the sheet metal panel.

A single-face marker may be converted into a double-face marker comprising inclined coloured bands on both faces by fixing a plate 1*b* on the reinforcing ribs 3*a*, 3*b*.

A roadmarker according to the invention further comprises a foldable support incorporated in the roadmarker and adapted to maintain it in vertical position perpendicularly to the highway, avoiding the panel being blown over by the wind.

The foldable support comprises four feet 4*a*, 4*b*, 4*c*, 4*d* which form two pairs disposed laterally, on either side of the rectangular panel 1, each pair being formed by two feet located in a vertical plane perpendicular to the plane of the panel 1.

The lower ends of the two front feet 4*a*, 4*c* are connected together by a crosspiece 5*a*.

Similarly, the lower ends of the two rear feet 4*b*, 4*d* are connected together by a crosspiece 5*b*.

The crosspieces 5*a*, 5*b* serve for abutment on the ground. They have a length clearly greater than the width of panel 1 and the distance between feet in order to increase the width of the support polygon and to give the roadmarker a good lateral stability. For example, the length of the crosspieces 5*a*, 5*b* is of the order of two to three times the width of the panel 1.

Figure 5:
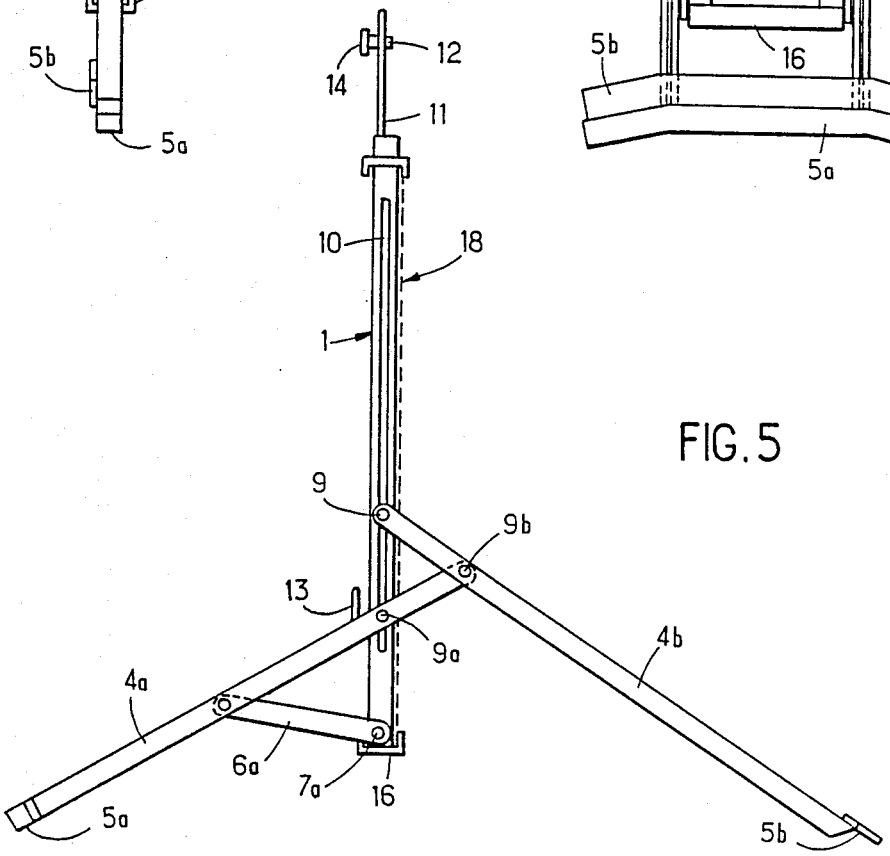
FIG. 5 shows a roadmarker according to Fig. 2 in side view in unfolded position.
Figure 6:
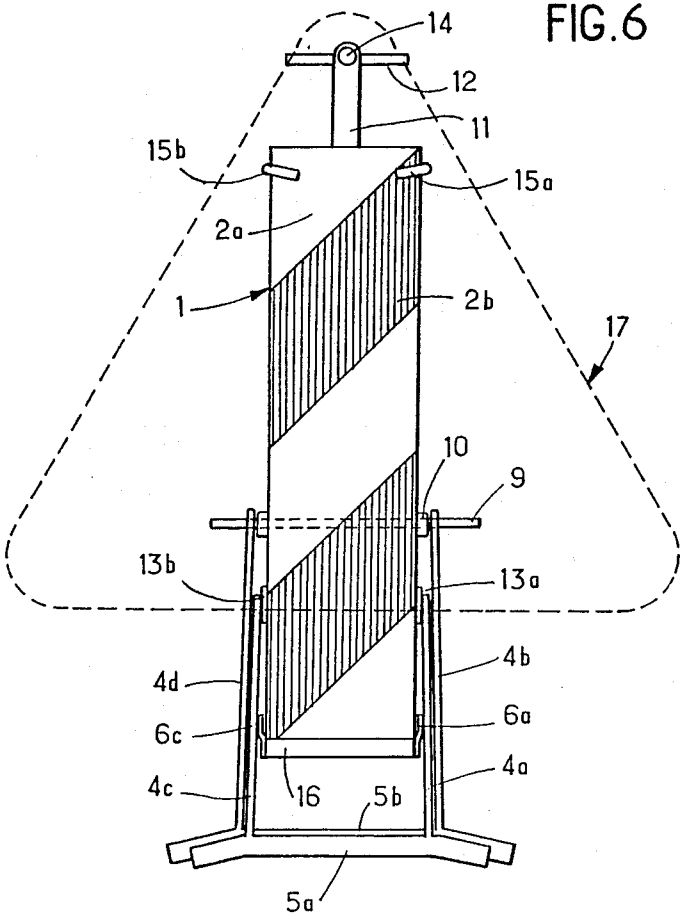
FIG. 6 shows a front view of a roadmarker according to FIG. 2 in unfolded position.

Crosspiece 5*a* is slightly shorter than crosspiece 5*b* in the embodiment according to FIGS. 1 and 6. They are of the same length in the embodiment of FIGS. 2 to 5.

In order to improve stability, the ends of the crosspieces 5*a*, 5*b* may be slightly curved or bent towards the ground.

The roadmarkers according to the invention are designed to be placed in special storage containers provided with slideways and they comprise means adapted to cooperate with these slideways in order to obtain folding or automatic opening of the roadmarker support when the latter is displaced along the slideways.

FIG. 1 shows a view in perspective of a first embodiment of a roadmarker according to the invention.

Each pair of feet located on the same side of the panel forms a pair of compasses of which the two legs 4*a*, 4*b* or 4*c*, 4*d* have the same length and are articulated on a transverse rod 9 which slides in two slots 10 cut out in the two ribs 3*a*, 3*b* which constitute the vertical edges of panel 1.

The rod 9 largely projects on each side of panel 1, and these extensions are adapted to slide in two slideways in the storage container.

Each of the feet of each pair is connected, moreover, to the lower end of the vertical edge of the panel located on the same side by an articulated connecting rod 6*a*, 6*b*, 6*c*, 6*d*. The two connecting rods placed on the same side are connected to the panel by a common articulation 7*a*, 7*b*.

When the roadmarker is placed on the ground, the two pairs of compasses tend to open until the rod 9 comes into abutment against the lower ends of the slots 10 and this position is a position of equilibrium.

The panel 1 is extended upwardly by a bar 11 bearing a transverse handle 12 which is likewise adapted to slide in two slideways of a storage container as will be explained hereinafter.

Figure 3:
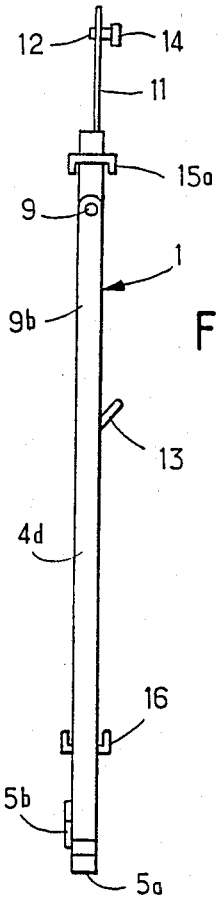
FIGS. 3 and 4 show the roadmarker according to FIG. 2 seen from the side and from the rear in folded position.

A roadmarker according to the invention may advantageously serve temporarily as a support for a temporary road sign, for example a triangular, square or circular panel. To this end, the roadmarker comprises two hooks or two brackets 13*a*, 13*b* which are fixed to the upper end of the rear feet, so that they project forwardly of the panel 1 when the roadmarker is open, as shown in FIG. 1, and retract into the thickness of the reinforcing sections 3*a*, 3*b* when the roadmarker is folded, as shown in FIG. 3.

When the roadmarker is open, the hooks 13*a*, 13*b* serve as support for the lower edge of a temporary road sign, which is placed in front of panel 1.

A roadmarker according to the invention advantageously comprises, in addition, another means of fixation 14, disposed at the upper end of bar 11.

FIG. 1 shows, by way of example, a means of fixation constituted by a projecting catch 14 which engages in a buttonhole-shaped hole in the panel. This catch 14 may be replaced by any equivalent temporary fixing means, for example by a threaded hole adapted to receive a bolt.

Figure 2:
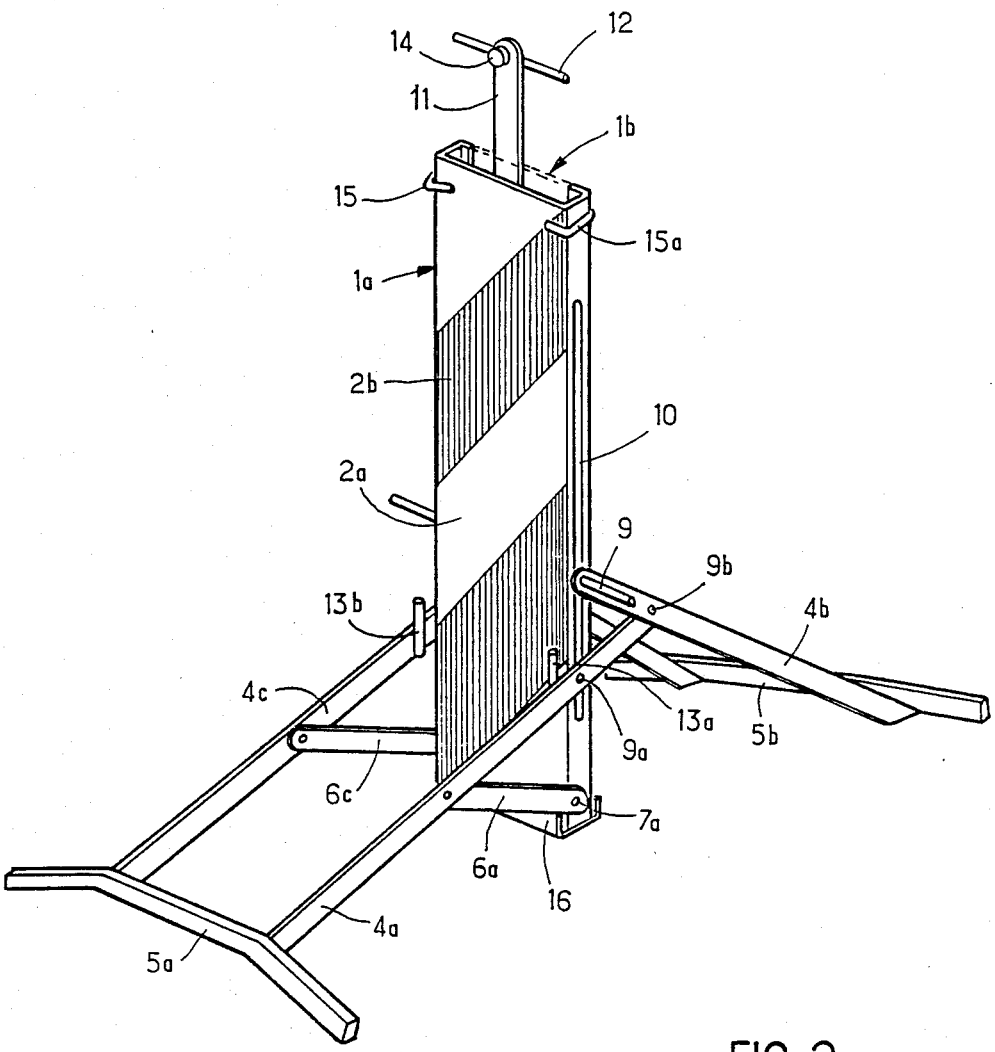
FIG. 2 is a view in perspective of a second embodiment of a roadmarker according to the invention.

The panel 1 presents coloured bands 2*a*, 2*b* which are inclined upwardly in one direction, for example to the right in the case of FIGS. 1 and 2.

It is advantageous to be able to convert these roadmarkers easily by modifying the direction of inclination of the reflecting bands visible on the front face (single-face roadmarker) or on both the front and rear faces (double-face roadmarker) or to convert a single-face roadmarker into a roadmarker presenting coloured bands on both faces.

To that end, a roadmarker according to the invention comprises, along its lateral edges, two rods 15*a*, 15*b* bent to form stirrups, of which the width is greater than the width of the reinforcing sections 3*a*, 3*b*. These stirrups are disposed in the same horizontal plane located above the upper ends of the slots 10 in order not to hinder slide of the rod 9 in these slots. They are welded by their centre on the reinforcing sections 3*a*, 3*b* and their 90°-bent ends extend to the front and to the rear of the panel 1, so that it is possible to slide a thin plate between the two stirrups and the front face of the panel 1 or between the two stirrups and the rear edges of the two sections 3*a*, 3*b*.

The thin plate is for example a strip of light alloy, having the same dimensions as the panel 1, which bears on its visible face the symbol in accordance with the regulations, for example reflecting bands of two alternate colours which are inclined by 45° to the right or to the left.

A roadmarker according to the invention further comprises, along the lower edge of the panel 1, a section 16 adapted to support the lower edge of the thin plate which is slid in the stirrups 15*a*, 15*b*.

The contour 17 of a temporary sign panel, which is placed on two hooks 13*a*, 13*b* and which is suspended from the suspension member 14, has been shown in broken lines in FIG. 6.

A thin indicator plate 18 which is placed against the rear face of the panel 1 has been shown in broken lines in FIG. 5.

FIGS. 2 to 5 show another preferred embodiment of a roadmarker according to the invention.

Like parts are represented by the same references in FIG. 1 and in FIGS. 2 to 5.

In this second embodiment, each pair of feet comprises a rear foot 4*b*, 4*d* which is shorter than the front foot 4*a*, 4*c* of the same pair, with the result that, after folding, the rear crosspiece 5*b* comes into position above the front crosspiece 5*a* whilst the feet overlap, this enabling much reduced dimensions in thickness to be obtained, as shown in FIG. 3.

In the embodiment according to FIGS. 2 to 5, the two feet forming the same pair are connected to the panel respectively by two superposed articulations 9 and 9*a* which slide in the same slot 10.

The two upper articulations are constituted, as in the example of FIG. 1, by a transverse rod 9 which projects on either side of the panel.

The foot which is connected to the lower articulation 9*a*, for example the front foot 4*a*, extends beyond this articulation 9*a* and it is connected to the other foot 4*b* of the same pair by an articulation 9*b*. Furthermore, the front feet are connected respectively to the two ends of the lower edge of the panel by two articulated connecting rods 6*a*, 6*c* which are connected to the panel by articulations 7*a*.

FIGS. 5 and 3 show views in elevation of a roadmarker according to FIG. 2, respectively in open position and in closed position in which the total thickness is equal to that of panel 1.

Figure 4:
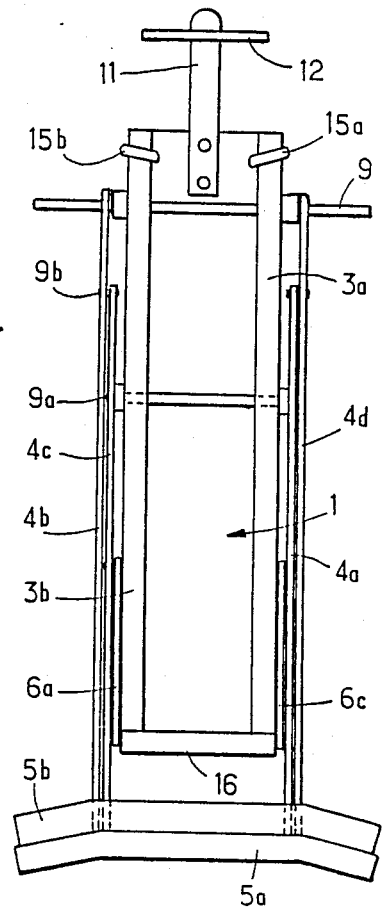

FIG. 4 is a view from the rear of a roadmarker according to FIG. 2, folded.

FIG. 6 is a front view of a roadmarker according to FIG. 1 in open position, in which the contour of a triangular panel 17 placed on the two hooks 13*a*, 13*b* and suspended from the suspension member 14, has been shown in broken lines.

FIGS. 2 to 5 show an embodiment of a roadmarker in which the panel 1 comprises, along its lower edge, a section 16 in which may be engaged a thin plate 18, to superpose it on the front face or on the rear face of said panel.

Figure 7:
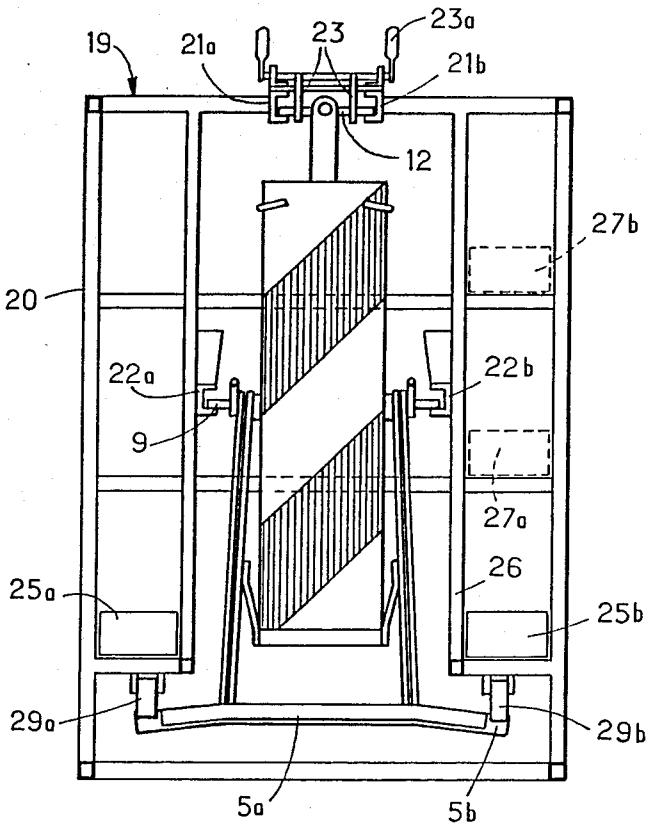
FIG. 7 is a transverse section of a first embodiment of a container according to the invention.

FIG. 7 shows a transverse section of a first embodiment of a parallelepipedic container 19 which is intended for storing an assembly of foldable roadmarkers according to FIGS. 1 and 6 and of temporary panels.

Figure 8:
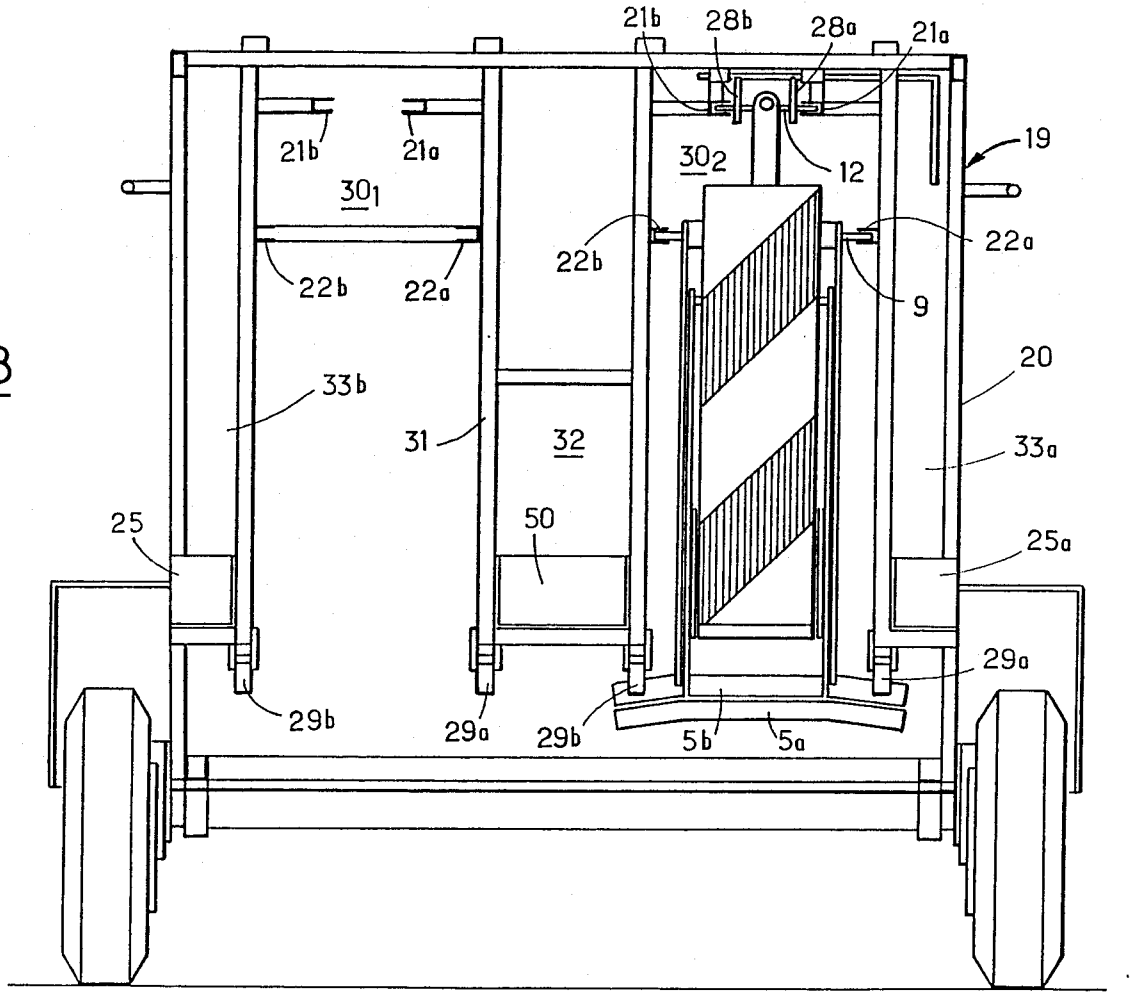
FIGS. 8 and 9 show a transverse section and a longitudinal section of another embodiment of a container according to the invention.
Figure 9:
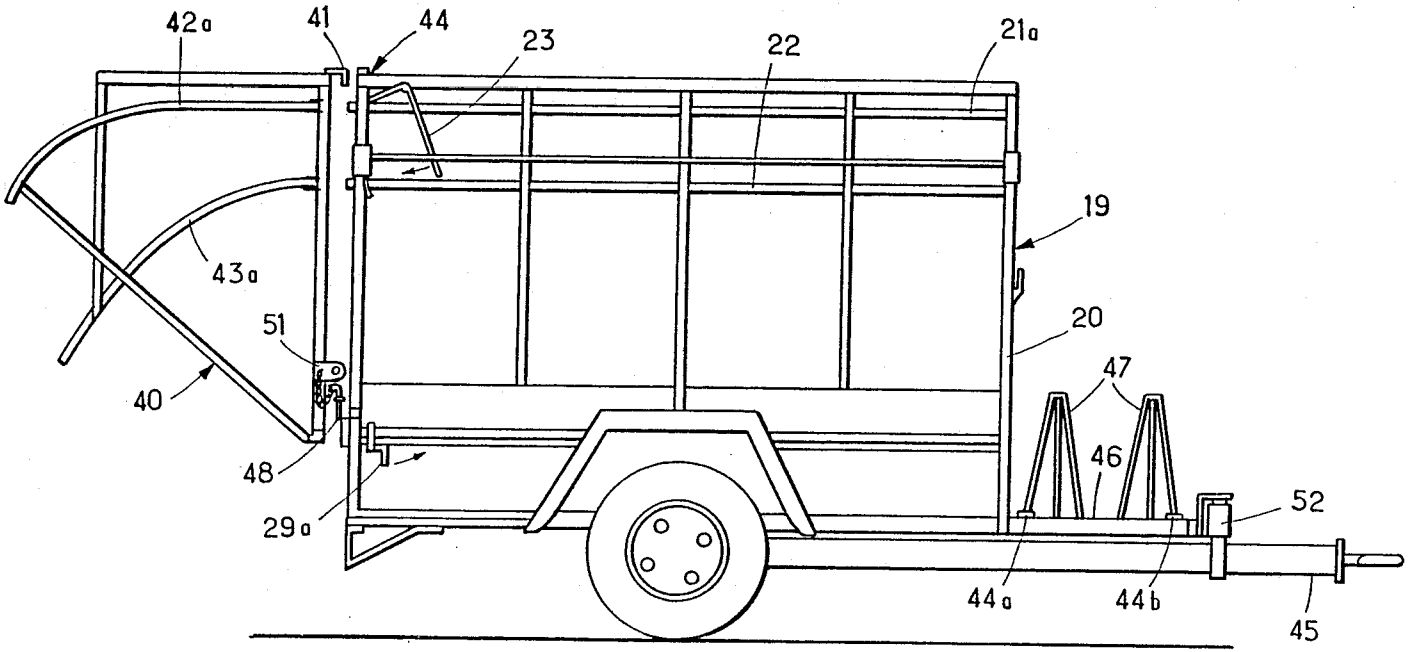

FIGS. 8 and 9 respectively show a transverse section and a view in elevation of a second embodiment of a double parallelepipedic container, intended for storing an assembly of foldable roadmarkers according to FIGS. 2 to 5 and of temporary panels. Each of these containers or box or bin 19 comprises a bearing structure 20 which is composed of uprights, crosspieces and possibly of boarding and which defines a parallelepipedic envelope.

The container 19 may be a fixed container intended only to store the roadmarkers or, preferably, a mobile container intended for transporting the roadmarkers and, in that case, it may be a box mounted on the chassis of a transporting vehicle or the structure forming envelope forms an integral part of a truck or a trailer as shown in FIG. 8.

A container 19 according to the invention is designed especially to receive the foldable roadmarkers according to the invention by facilitating folding and opening thereof. It comprises, on the one hand, members adapted to receive, to fold and to dispense the foldable roadmarkers, on the other hand, lateral bins intended to receive temporary sign panels or thin plates adapted to be fitted on the foldable roadmarkers.

The members adapted to receive the foldable roadmarkers comprise two longitudinal horizontal rails 21*a*, 21*b* which are fixed to the roof of the container in the median part thereof and which are symmetrical with respect to the longitudinal median plane. The two rails 21*a*, 21*b* form a runway. They are constituted for example by two U-sections, of which the openings are directed opposite each other. The distance between the webs of the two sections is very slightly greater than the length of the handles 12 which constitute the handles of the roadmarkers, with the result that these handles may rest on the lower flanges of the sections and slide freely in the runway defined thereby.

In order to facilitate slide of the handles 12 in the rails, each of the half-handles may be covered with a small tube which rolls in the sections 21*a*, 21*b*.

The members adapted to receive the roadmarkers comprise, in addition, two rectilinear slideways 22*a*, 22*b* which are fixed to the bearing structure, at a determined height. The two slideways 22*a*, 22*b* are constituted for example by two U-sections whose openings are placed opposite each other or by two sections in the form of an open tube comprising only one narrow slot over their inner faces or by any other equivalent section.

FIG. 9 shows a container 20 forming part of a trailer which further comprises a removable dispensing device 40 which is hooked to the rear of the trailer during the operations of collecting the roadmarkers and during the operations of placing them on the highway.

The device 40 comprises a framework composed of metal sections, which comprises hooking means 41 temporarily fixed on complementary means 44 placed at the rear of the trailer.

The dispenser comprises one or two pairs of upper rails 42*a*, 42*b* and one or two pairs of intermediate rails 43*a*, 43*b*.

When the dispenser is hooked to the trailer, the rear ends of the rails 42*a*, 42*b* are in line with rails 21*a*, 21*b* and the rear ends of the rails 43*a*, 43*b* are in line with rails 22*a*, 22*b*. Rails 42*a*, 42*b* and 43*a*, 43*b* are curved towards the ground and rearwardly, as shown in FIG. 9.

FIG. 7 shows a transverse section of a container which comprises one pair of upper rails 21*a*, 21*b* and one pair of intermediate rails 22*a* and 22*b* and it shows a roadmarker according to FIG. 1, in place in the container which may receive one row of roadmarkers only. This figure shows the rod 9 in abutment in the two slideways 22*a*, 22*b* and the handle 12 in abutment in the two upper rails 21*a*, 21*b*.

The height between the slideways 22*a*, 22*b* and the upper rails 21*a*, 21*b* is equal to the height between the upper end of the lateral slots 10 and the handles 12 of the roadmarkers, with the result that, when the roadmarkers are placed inside the container, they are entirely folded.

FIG. 7 shows an embodiment of a retractable bolt 23 which is placed between the rear ends of the rails 21*a*, 21*b* and which can be manoeuvred by handles 23*a*.

When the bolts 23 are in the pivoted position shown in FIG. 7, the handles 12 come into abutment against these bolts, so that the roadmarkers cannot leave the container.

The container according to FIG. 7 further comprises two pivoting bolts 29*a*, 29*b* which may pivot only forwardly. These bolts are fixed to the lower part of the superstructure 26 and their function is to block the rear lower crosspiece 5*b* of each roadmarker support which is longer than the front crosspiece in order to provoke automatic opening of the support when a roadmarker is brought out of the container.

FIG. 7 shows a container which comprises, in addition, on either side of the central compartment reserved for storing the roadmarkers, bins in which temporary sign panels such as panel 17 or thin plates 18 adapted to be used in association with the foldable roadmarkers, may be stored. The container according to FIG. 7 comprises two horizontal bins 25*a*, 25*b* in the form of troughs or chutes, which are disposed longitudinally on each side of the container, on a bearing structure 26, which maintains them elevated with respect to the floor of the container in order to leave a free passage for the crosspieces 5*a*, 5*b* which project laterally. This arrangement allows optimum use of the volume of the container.

The panels 17 and plates 18 are stored vertically in the bins 25*a*, 25*b* abut against the lateral faces of the container and against the uprights 26 of the bearing structure. The panels and plates stored in the bins may easily be removed from the container or introduced thereinto from the rear. FIG. 7 shows in broken lines a variant embodiment of a container comprising, on one of its sides, three superposed bins 25*b*, 27*a*, 27*b* which make it possible to store thin plates 18 having a width of 25 cm.

FIG. 8 shows in section a trailer adapted to receive two rows of roadmarkers according to FIG. 2. This trailer comprises two retractable bolts 28*a*, 28*b* located between the rear ends of the rails 21*a*, 21*b* and 22*a*, 22*b* and pivoting bolts 29*a*, 29*b* located in the lower part of the box and whose function will be explained hereinbelow.

FIG. 8 is a view in transverse section of a trailer according to FIG. 9 of highway gauge, which comprises two juxtaposed compartments $30_1$ and $30_2$ reserved for the storage of the roadmarkers. Each compartment comprises two upper rails 21*a*, 21*b* and two intermediate rails 22*a*, 22*b* in which the upper handle 12 and the transverse rod 9 of each roadmarker respectively slide. The trailer presents an internal structure 21 composed of metal sections which supports the rails and which defines a central compartment 32 and two lateral compartments 33*a*, 33*b* adapted to contain panels 17 or plates 18.

The right-hand half-view shows the retractable bolt 28*a*, 28*b* placed between the rear ends of the upper rails 21*a*, 21*b*. Also shown are the two pivoting bolts 29 which are fixed to the lower ends of the bearing structure 31 framing each compartment $30_1$ and $30_2$.

It has been seen that the foldable roadmarkers according to FIGS. 2 to 5 comprise a rear crosspiece 5*b* placed slightly above the front crosspiece 5*a*. The bolts 29 are placed at a level slightly higher than that where the crosspieces 5*a* are located when the roadmarkers are suspended from rails 21*a*, 21*b* and are folded.

In this way, when a roadmarker is taken out of the trailer, the front crosspiece 5*a* avoids the bolts 29 whilst the rear crosspiece 5*b* comes into abutment thereagainst. When the roadmarker advances towards the rear in the dispenser 40, it opens whilst pivoting and it is thanks to such pivoting that the rear crosspiece escapes the bolts 29.

The same system of opening is applicable for the roadmarkers according to FIG. 1. The difference in height between the crosspieces 5*a* and 5*b* is then replaced by a difference in length as may be seen in FIG. 7. Thus, in any case, when a roadmarker is taken out of the container, the rear crosspiece 5*b* is retained by the bolts 29*a* and 29*b*, which provokes automatic opening of the support.

When a roadmarker is introduced into the dispenser and is pushed inside the box, the rear crosspiece encounters the two bolts 29 but the latter may pivot freely forward and they retract to allow the roadmarker to pass.

A trailer according to FIG. 9 which comprises two compartments $30_1$ and $30_2$ for storing the roadmarkers is advantageously used in combination with a dispenser 40, whose width is equal to that of a compartment and which is hooked successively to the rear of one compartment, then to the rear of the other by the hooks 41 which are fixed to catches 44, fixed above the rear crosspiece of the container.

FIGS. 7 to 9 explain the use of a container or trailer according to the invention for collecting the roadmarkers according to FIG. 1 or FIGS. 2 to 5, from the highway.

The upper bolts 21*a*, 21*b* are maintained open by pivoting the handles 23.

Handle 12 of an open roadmarker is then engaged between the rear ends of a pair of rails 42*a*, 42*b* of the dispenser 40 and rod 9 of the roadmarker is engaged between the rear ends of a pair of rails 43*a*, 43*b* of the dispenser.

An operator pushes the roadmarker forwards. The handle 12 slides in the rails 42*a*, 42*b* and the rod 9 slides in rails 43*a*, 43*b*, approaching the handle, since, as may be seen in FIG. 9, the vertical distance between the rails 42*a*, 42*b* and the slideways 43*a*, 43*b* decreases forwardly. When the roadmarker arrives at the rear end of the dispenser 40 and penetrates into the container, its support is entirely folded.

FIG. 9 shows that the trailer comprises at the front a drawbar 45 enabling it to be hooked behind a vehicle. This drawbar 45 supports an area 46 on the left part of which are fixed conical structures 47 for storing interfitting conical roadmarkers.

The right-hand part of this area 46 bears two catches 44*a*, 44*b* identical to catches 44.

In this way, during the displacements of the container or of the trailer, the removable dispenser 40 is fixed horizontally on the front area on the one hand with the aid of hooks 41 which engage in the two catches 44*a*, 44*b* and, on the other hand, by means of two fork joints 51 which are each locked by a pin 48.

FIG. 8 shows that the central compartment 32 comprises, in its lower part, a bin 50 adapted to receive sign panels 17 (triangular, square or circular). The bins 25*a*, 25*b* located in the lower part of the lateral compartments 33*a*, 33*b* are adapted to receive thin plates 18 bearing the symbol in accordance with regulations with bands inclined in opposite direction.

A trailer according to the invention advantageously comprises means for pivoting it to incline it rearwardly in order to facilitate unloading of the roadmarkers. These means may be constituted for example by a jack 52 fast with the drawbar of the trailer.

What is claimed is:

1. A container for storing foldable roadmarkers, comprising a flat panel which is mounted on a foldable support comprising two pairs of feet, each pair being composed of two feet articulated together and located respectively in two vertical planes, perpendicular to the plane of said panel and located respectively on either side of said panel, wherein at least one of the two feet of each pair is articulated about a transverse rod which slides freely in two vertical slots cut out along the two vertical edges of said panel and which projects on both sides of said panel and wherein said panel is extended upwardly by a bar bearing a transverse handle, which container comprises, in its upper part, at least one pair of horizontal and longitudinal rails of which the spaced apart relationship is slightly greater than the length of the handles of the roadmarkers which slide in said rails, and it comprises at least one pair of horizontal and longitudinally slideways of which the spaced apart relationship is slightly greater than the length of the transverse rods of said roadmarkers which slide in said slideways and the height between said rails and said slideways is equal to the height between the handle and the upper ends of the slots of said roadmarkers.

2. The container of claim 1, further comprising a removable dispensing device which comprises a bearing structure provided with means for removably hooking it to the rear of said container, and at least one pair of rails and at least one pair of slideways whose rear ends come into position respectively in line with said upper rails and said slideways when said dispenser is hooked to the container and said rails and slideways of the dispenser are curved downwardly and rearwardly, so that the vertical distance which separates them increases rearwardly.

3. The container of claim 2, comprising two juxtaposed compartments for storing the roadmarkers which are each equipped with a pair of rails in the upper part and with a pair of slideways and said removable dispenser has a width substantially equal to that of a compartment, it comprises one sole pair of upper rails and one sole pair of slideways and it is successively hooked to the rear of one compartment then to the rear of the other compartment.

4. The container of claim 1, further comprising horizontal boxes disposed on each side of the compartments for storing the roadmarkers and adapted to receive thin plates usable in association with foldable roadmarkers and a central box adapted to receive temporary marker panels, which boxes are supported by a structure of which the lower end is elevated with respect to the floor of the container, with the result that there is a free space between this structure and the floor for the passage of the crosspieces of said roadmarkers.

5. The container of claim 4, for storing foldable roadmarkers, which roadmarkers comprise two crosspieces which connect together, respectively, the two front feet and the two rear feet, wherein the rear crosspiece which connects the two rear feet is located at a level slightly higher than the level of said front crosspiece when the support is folded, said container having two pivoting bolts which are located on either side of the rear end of said container for storing the roadmarkers, said pivoting bolts being located at the level of said rear crosspieces when said roadmarkers are suspended by said handle from said upper rails.

* * * * *